US010939765B1

(12) United States Patent
Reily

(10) Patent No.: US 10,939,765 B1
(45) Date of Patent: Mar. 9, 2021

(54) MODULAR ARMCHAIR REST

(71) Applicant: Marion Paul Reily, Mesquite, TX (US)

(72) Inventor: Marion Paul Reily, Mesquite, TX (US)

(73) Assignee: Marion Paul Reily, Mesquite, TX (US)

( * ) Notice: Subject to any disclaimer, the term of this patent is extended or adjusted under 35 U.S.C. 154(b) by 0 days.

(21) Appl. No.: 16/545,513

(22) Filed: Aug. 20, 2019

(51) Int. Cl.
*A47C 7/54* (2006.01)
*A47C 7/68* (2006.01)
*A47C 7/62* (2006.01)
*A47C 1/124* (2006.01)

(52) U.S. Cl.
CPC ..... *A47C 7/54* (2013.01); *A47C 7/624* (2018.08); *A47C 7/68* (2013.01); *A47C 1/124* (2013.01)

(58) Field of Classification Search
CPC ..... A47C 7/54; A47C 7/546; A47C 7/624; A47C 7/68; A47C 1/124
See application file for complete search history.

(56) References Cited

U.S. PATENT DOCUMENTS 4,262,962 A * 4/1981 Yust ..... A47C 7/70 297/188.18
4,795,211 A * 1/1989 Stern ..... A47C 7/624 297/188.18
5,238,212 A * 8/1993 Dechellis ..... B60N 3/102 248/311.2
5,395,085 A * 3/1995 Mann ..... A47C 7/68 248/311.2
5,533,782 A * 7/1996 Goldman ..... A47C 7/62 297/188.18
6,827,405 B1 * 12/2004 Roberts ..... A47C 7/546 297/188.18
7,360,829 B2 * 4/2008 Bufkin ..... A47C 7/70 297/162
7,431,396 B1 * 10/2008 Dasso ..... A47C 7/546 297/227
8,777,307 B2 * 7/2014 Nelson ..... A47C 7/70 297/188.18
9,623,776 B2 * 4/2017 Colsky ..... B60N 2/77
9,708,068 B2 * 7/2017 Thorn ..... A47G 9/0223
9,756,946 B2 * 9/2017 Chang ..... B60N 2/787
2011/0133537 A1 * 6/2011 Salee ..... A47C 7/546 297/411.23
2012/0181837 A1 * 7/2012 Meador ..... A47C 7/546 297/411.23

* cited by examiner

*Primary Examiner* — Philip F Gabler

(57) ABSTRACT

A modular armchair rest for installation and removal during a variety of events at facilities having small fixed and rotating armrest between seats. Users clip one or two modular armchair rests to give patrons additional armrest area. Accessories, such as cupholders and trays, can be removably attached to the modular armchair rest.

5 Claims, 10 Drawing Sheets

MODULAR ARMCHAIR REST

BACKGROUND

1. Field of the Invention

The present invention relates generally to seating improvements, and more specifically to a system and method for supporting user's arms with removable rests.

2. Description of Related Art

Seating in a stadium or theater poses issues for guests in regards to the armchair rests located between seats. Typically there is a single arm rest between each seat, tension typically ensues because both patrons cannot share the single arm rest. In some instances the first patron enjoys use of the arm rest while the second patron is forced to go without an armrest. Alternatively each patron jostles elbows in an attempt to secure the armrest for the event. Additionally, conventional armrests are typically not sanitized after events and pose a health risk for patrons.

Referring now to FIG. 1 in the drawings, a perspective view of a conventional armchair illustrated according to the present application. Conventional seating 101 is comprised of a frame 103 rigidly attached to the stadium, a first seat 105, a second seat 107, a first armrest 109 located between the first seat 105 and the second seat 107, and end arm rests 111. First seat 105 is comprised of a first seat back 113 and a first seat bottom 115 rotationally coupled to frame 103. As shown the first armrest 109 is shared between the first seat 105 and the second seat 107 and typically used by the first user in either seat as the first armrest 109 is typically so small to be unusable to both occupants of first seat and second seat. First armrest 109 is typically fixed in place having a narrow upper surface 117 and a rib 119 of the frame underneath the armrest. Many seating configurations are different based upon the specific location and type of seating, however they all include shared armrests. While there are many systems for armchair rests known in the art, considerable room for improvement remains.

DESCRIPTION OF THE DRAWINGS

The novel features believed a characteristic of the embodiments of the present application is set forth in the appended claims. However, the embodiments themselves, as well as a preferred mode of use, and further objectives and advantages thereof will best be understood by reference to the following detailed description when read in conjunction with the accompanying drawings, wherein:

Figure 1:
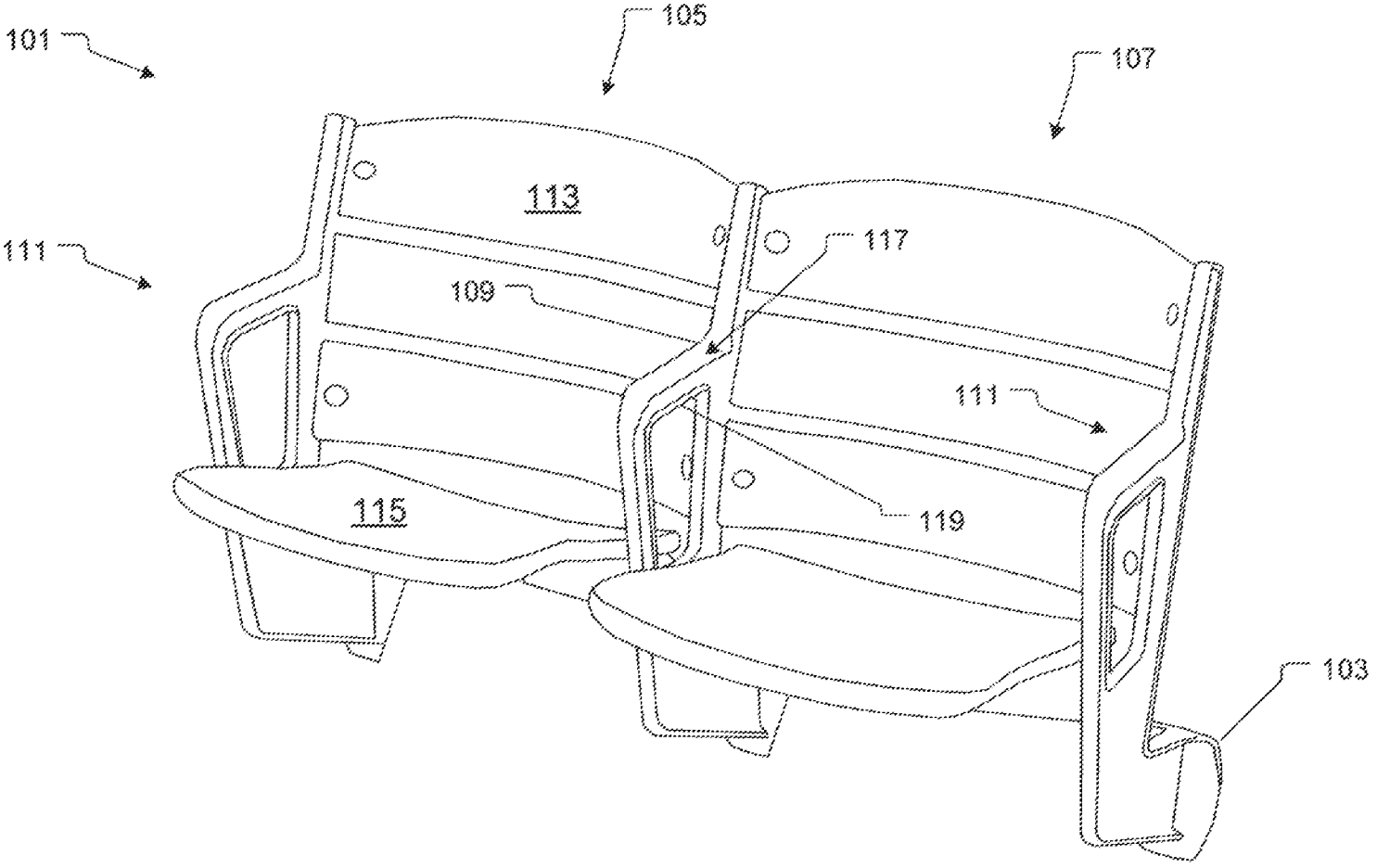
FIG. 1 is a perspective view of a conventional armchair rest illustrated according to the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the apparatus for a modular armchair rest are provided below. It will, of course, be appreciated that in the development of any actual embodiment, numerous Implementation-specific decisions will be made to achieve the developer's specific goals, such as compliance with assembly-related and business-related constraints along with different applications for various venues, which will vary from one implementation to another. Moreover, it will be appreciated that such a development effort might be complex and time-consuming, but would nevertheless be a routine undertaking for those of ordinary skill in the art having the benefit of this disclosure.

Improved modular armchair rests provide users with the ability to improve their seating in stadiums, movie theaters, opera houses, and other locations where patrons share armrests. The Improved modular armchair rest couples to the existing arm chair and provides additional space for the user's arm. Typically each armrest is configured so that a user can add at least one modular rest to one side of their folding chair, or perhaps one modular rest to each side of the armrest. Alternatively, the modular armchair rest is configured to span the armrest and provide additional space for each user on both sides of the armchair.

Figure 2:
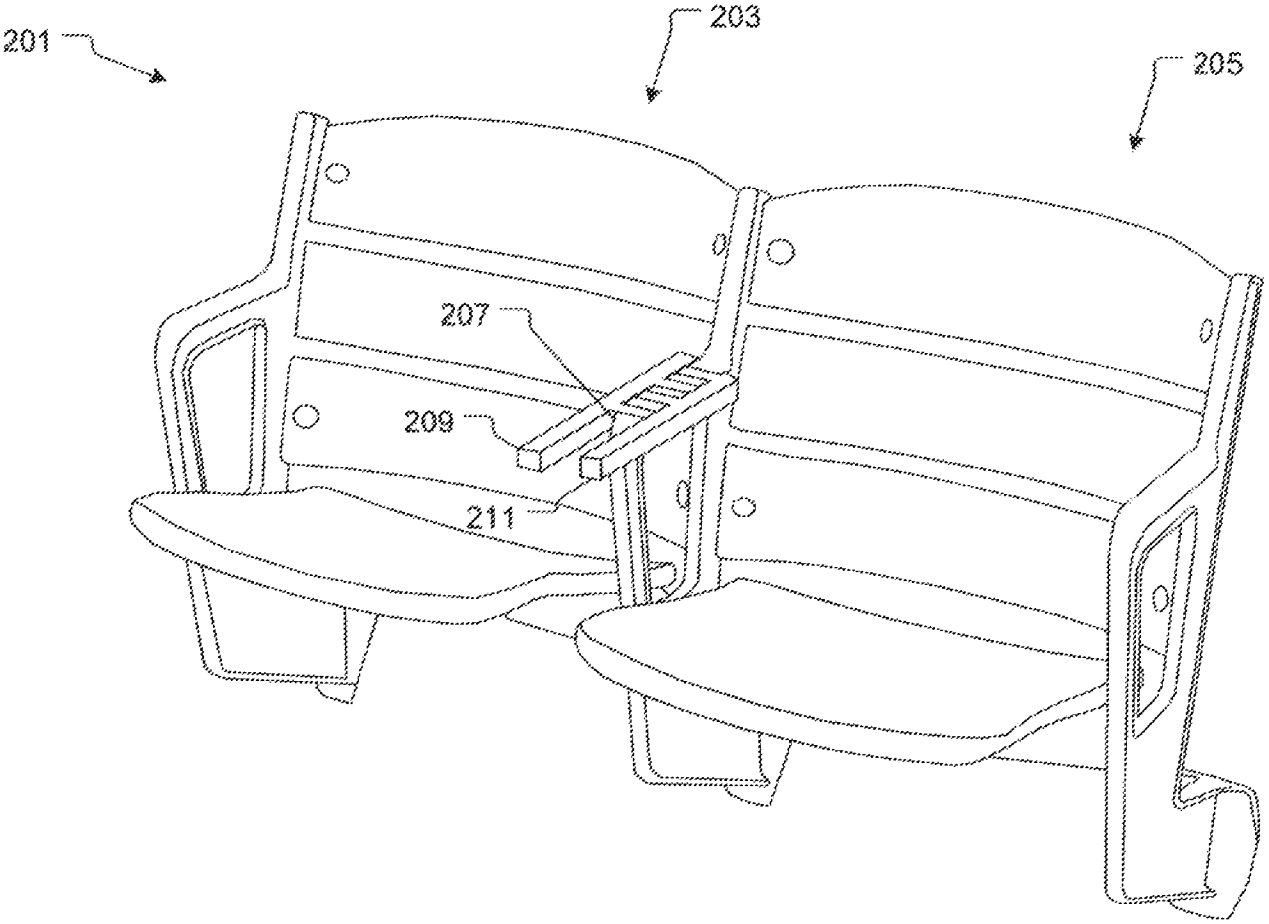
FIG. 2 is a perspective view of a modular armchair rest illustrated according to the present application.

Referring now also to FIG. 2 in the drawings, a perspective view of an improved modular armchair rest illustrated according to the present application. System 201 is comprised of a first seat 203, a second seat 205, a first armrest 207 located between the first seat and the second seat, a first modular armrest 209, and a second modular armrest 211. First modular armrest 209 clips to the first armrest 207 with a plurality of clips that retain an upper surface and a lower surface of the first armrest 207. Second modular armrest 211 clips to the first armrest 207 with a plurality of clips that retain an upper surface and a lower surface of the first armrest 207. While the preferred embodiment as illustrated is shown in baseball stadium seating, other seating arrangements are contemplated by this application.

Figure 3:
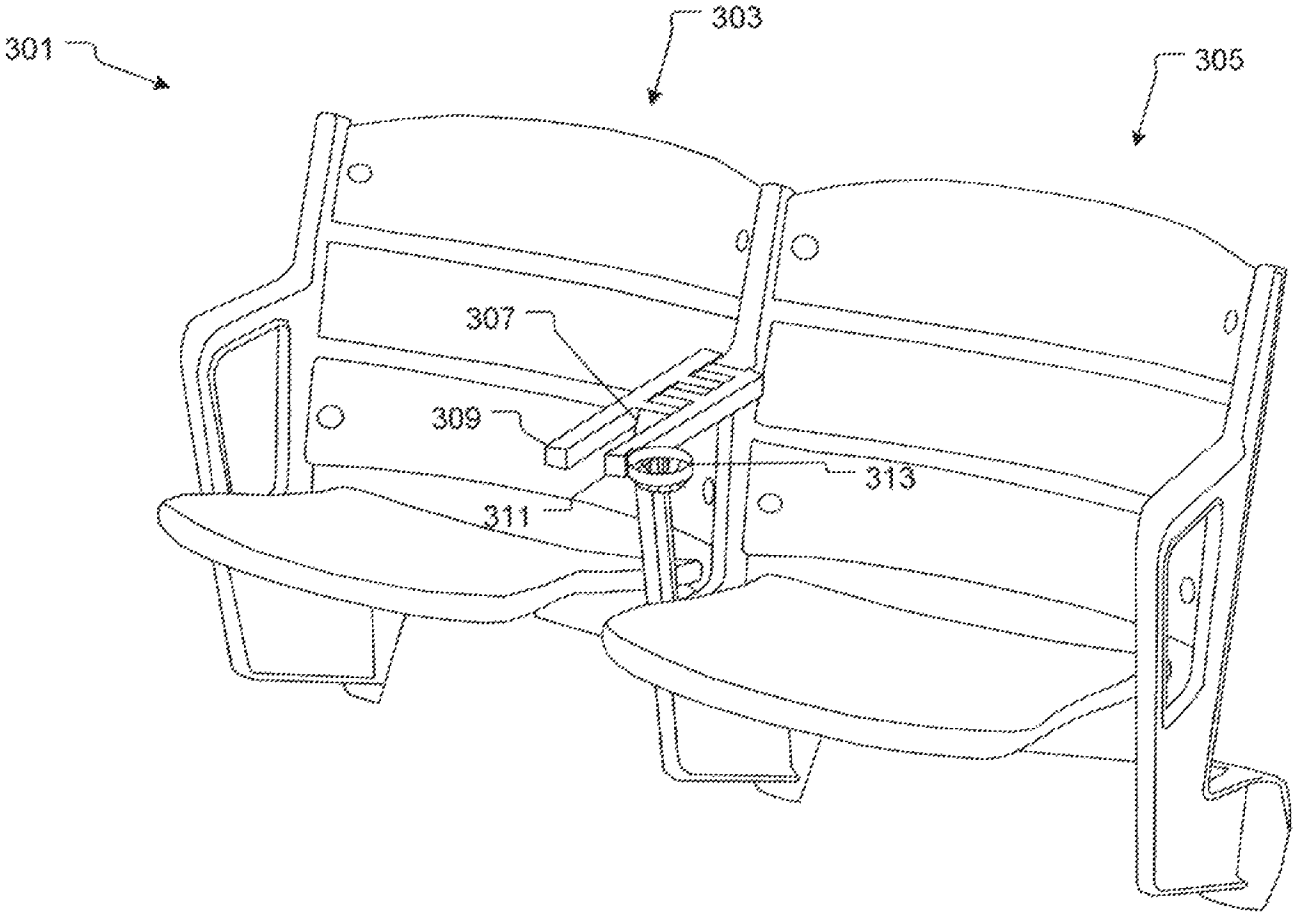
FIG. 3 is a perspective view of a modular armchair rest with removable cupholder illustrated according to the present application.

Referring now also to FIG. 3 in the drawings, a perspective view of an improved modular armchair rest illustrated according to the present application. System 301 is comprised of a first seat 303, a second seat 305, a first armrest 307 located between the first seat and the second seat, a first modular armrest 309, and a second modular armrest 311. First modular armrest 309 clips to the first armrest 307 with a plurality of clips that retain an upper surface and a lower surface of the first armrest 307. Other elements are contemplated to couple the first modular armrest 309 to the first armrest 307 in addition to or in place of the clips such as hook and loop tape, clamps, adhesive pads, fasteners, and magnets. Second modular armrest 311 clips to the first armrest 307 with a plurality of clips that retain an upper surface and a lower surface of the first armrest 307. Second modular armrest 311 further comprises a removable cup holder 313 attached by a grooved slot located in the second modular armrest. Other removable items are contemplated in place or in addition to the removable cup holder such as a removable tray, a cell phone holder, a battery pack, a book rest. Furthermore, while preferably the cup holder is removable, it should be apparent that the cup holder could be integrally formed in the second modular armrest. In the preferred embodiment each of the two modular armchair rest are identical and the user can attach them to either side of their chair as needed. Alternatively, each modular armchair rest is configured for a specific side of the users chair and not able to be moved from the left side to the right side. While the preferred embodiment couples the first modular armrest 309 to the first armrest 307 and the second modular armrest 311 to the first armrest 307 independently, alternatively each modular armrest can couple to each other.

Figure 4C:
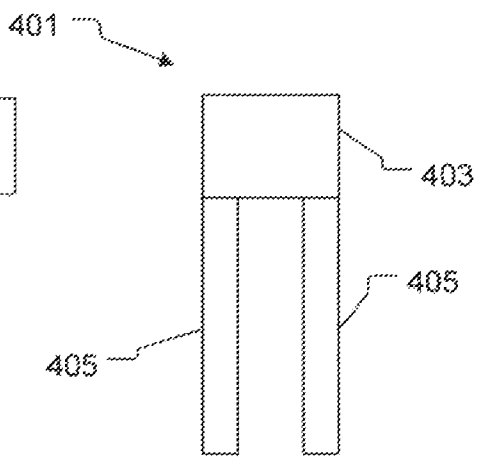
FIG. 4C is an end view of a modular armchair rest illustrated according to the present application.
Figure 4A:
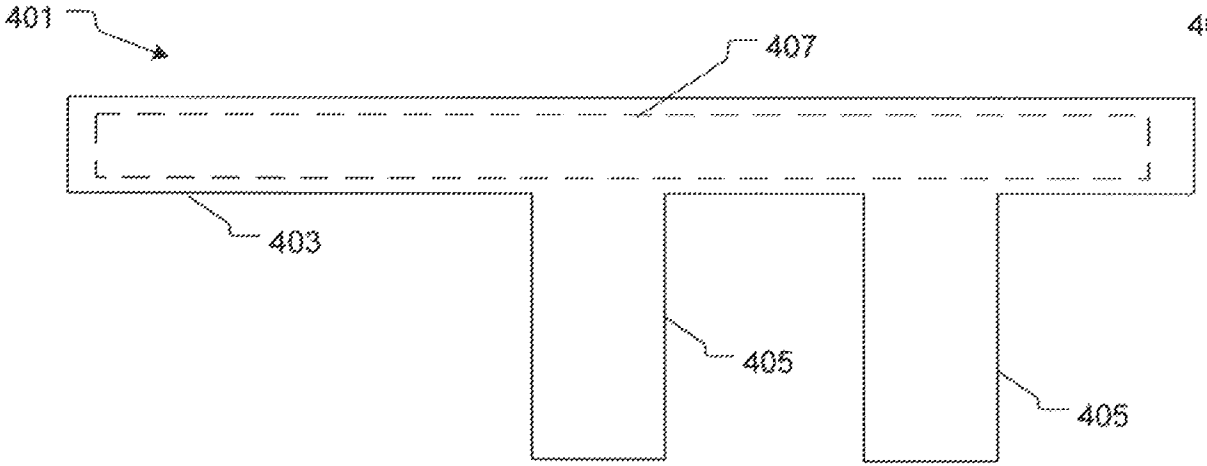
FIG. 4A is a top view of a modular armchair rest illustrated according to the present application.
Figure 4B:
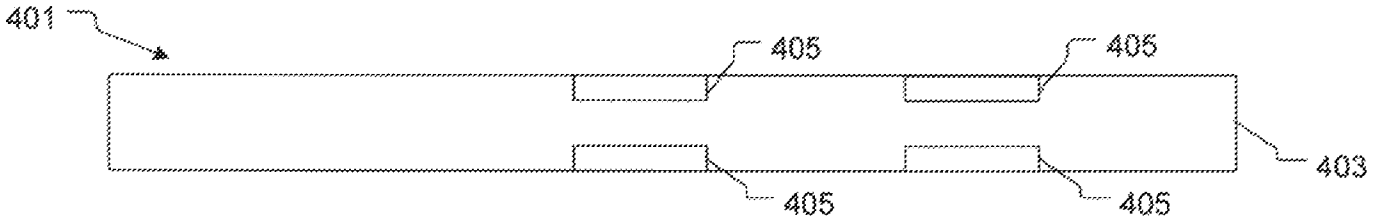
FIG. 4B is a side view of a modular armchair rest illustrated according to the present application.

Referring now also to FIGS. 4A-4C in the drawings, various views of an improved modular armchair rest illustrated according to the present application. Modular armchair rest 401 is comprised of a main member 403 and a plurality of finger 405 extending from the main member 403. Additionally, modular armchair rest 401 comprises surface 407 located on main member 403 for advertising indicia such as a screen printed logo for the stadium where the seating is located. Alternatively, the logo may be molded into the rest 401 and the material chosen selectively chosen to contrast with the existing stadium structure. Other locations are contemplated for advertising indicia on the modular armchair rest 401. Modular armchair rest 401 allows advertisers to provide armchairs for each occupant of the stadium regardless of the stadium ownership. For example, a fan of team A can bring their modular armchair rest to each home game and away games so long as each stadium has similar seating configuration.

Figures 5A, 5B, 5C:
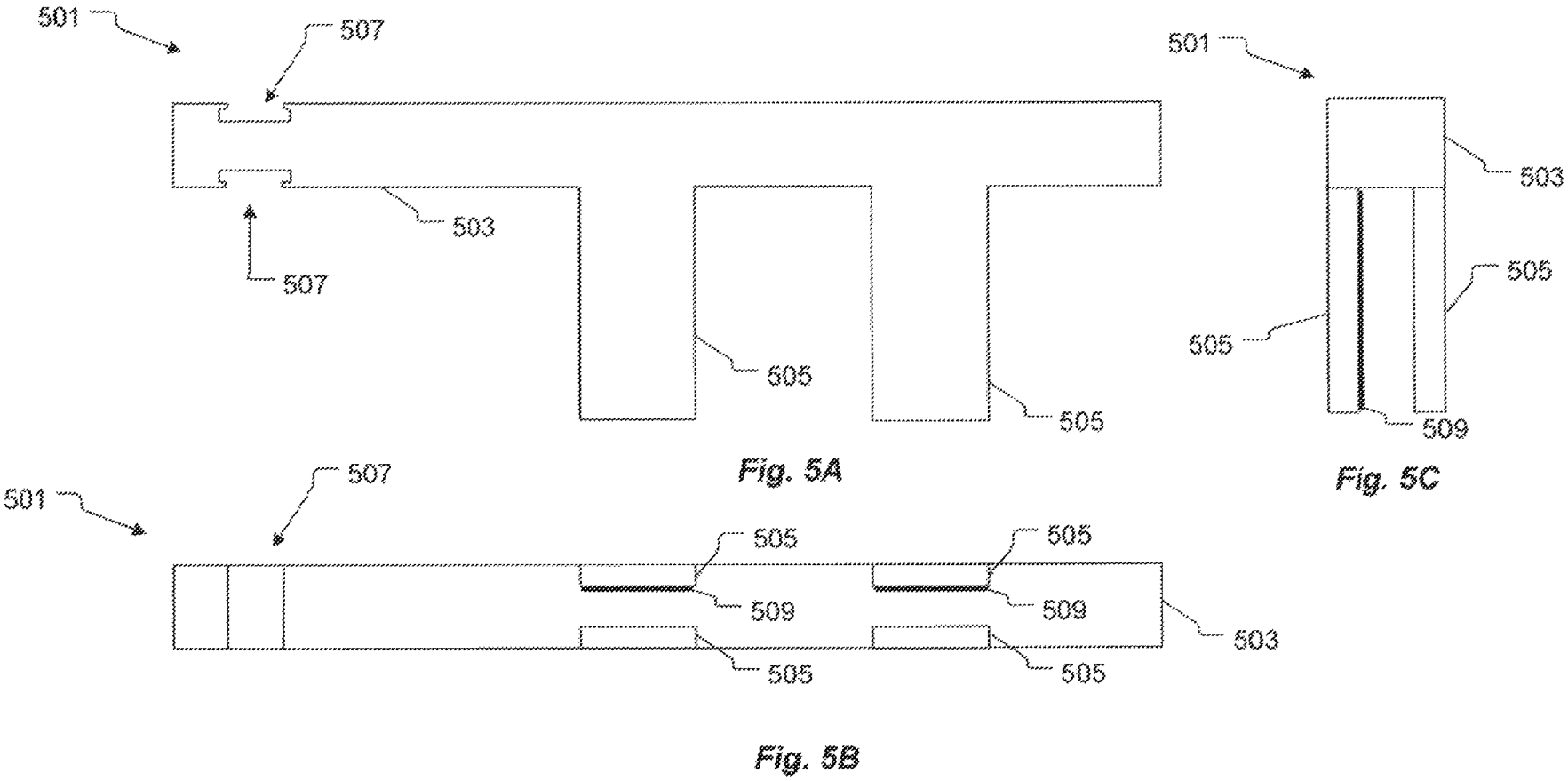
FIG. 5A is a top view of a modular armchair rest illustrated according to the present application.
FIG. 5B is a side view of a modular armchair rest Illustrated according to the present application.
FIG. 5C is an end view of a modular armchair rest Illustrated according to the present application.

Referring now also to FIGS. 5A-5C in the drawings, various views of an improved modular armchair rest illustrated according to the present application. Modular armchair rest 501 is comprised of a main member 503, a plurality of finger 505 extending from the main member 503, and a pair of grooved slots 507. Grooved slots 507 are configured to allow users to slidingly couple cupholders, trays, phone holders, and other accessories to the modular armchair rest 501. Modular armchair rest 501 further comprises adhesive 509 or hook and loop tape to help stabilize the rest 501 relative to the chair.

Figure 6A:
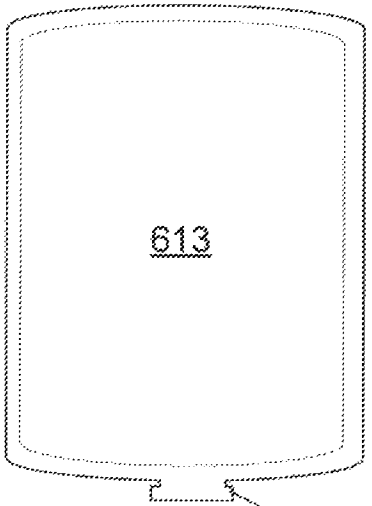
FIG. 6A is a top view of a cupholder illustrated according to the present application.
Figure 6B:
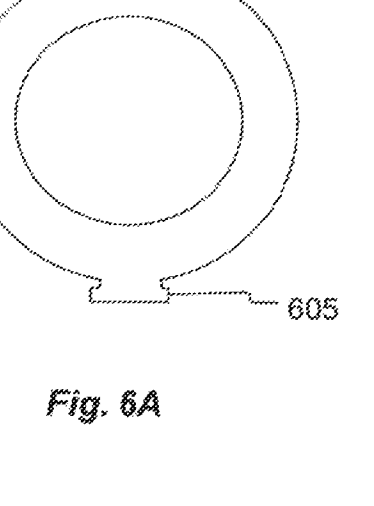
FIG. 6B is a top view of a tray illustrated according to the present application.

Referring now also to FIG. 6A in the drawings, a top view of a cupholder for an improved modular armchair rest illustrated according to the present application. Cupholder 601 is comprised of an annular ring 603 having a lipped member 605. Lipped member 605 is configured to be retained by a grooved slot of an improved modular armchair rest.

Referring now also to FIG. 68 in the drawings, a top view of a tray for an improved modular armchair rest illustrated according to the present application. Tray 611 is comprised of a platform 613 having a lipped member 615. Lipped member 615 is configured to be retained by a grooved slot of an improved modular armchair rest. Tray 611 is configured to allow users to rest hotdogs, nachos, and other Items on the tray.

Figure 7:
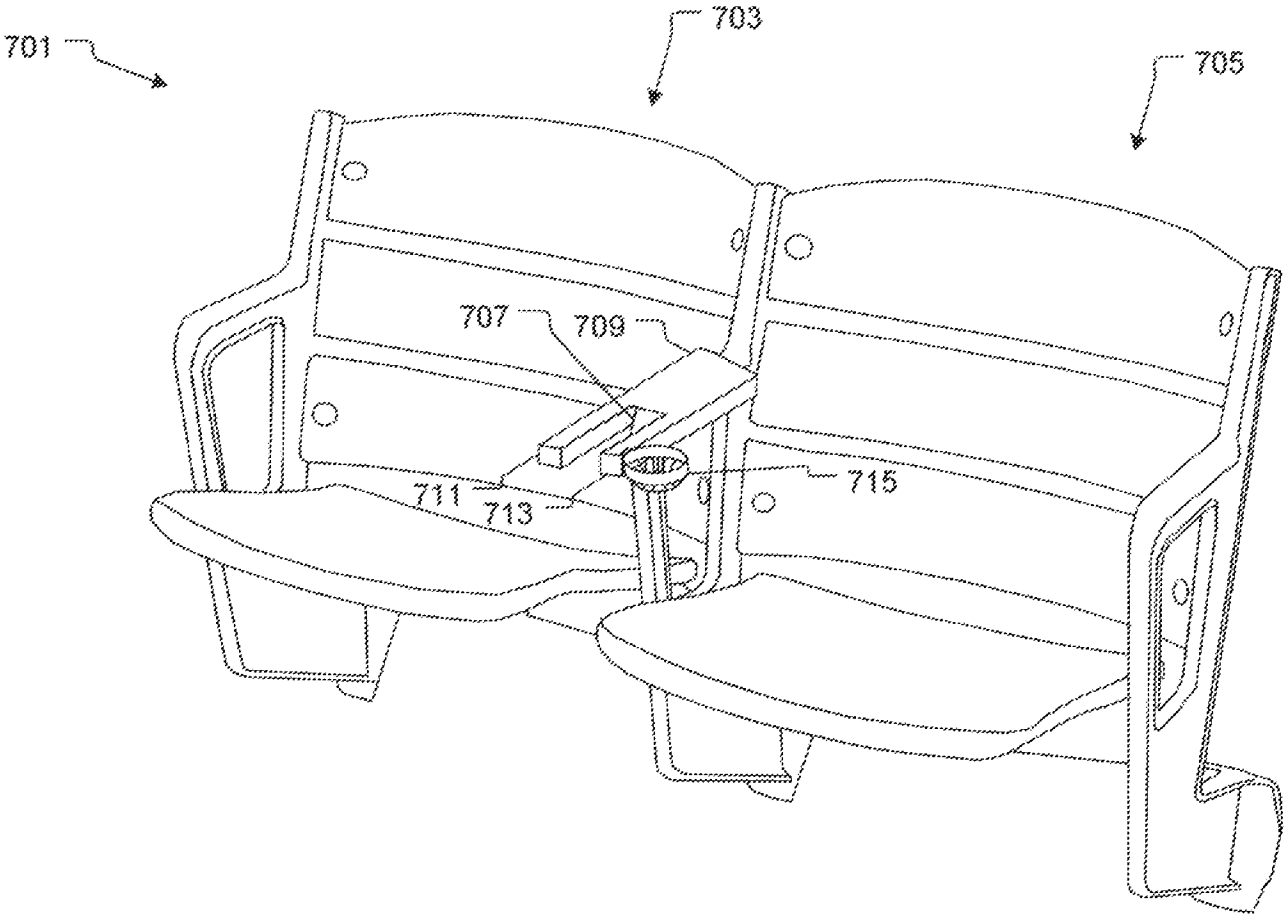
FIG. 7 is a perspective view of a modular armchair rest illustrated according to the present application.

Referring now also to FIG. 7 in the drawings, a perspective view of an improved modular armchair rest illustrated according to the present application. System 701 is comprised of a first seat 703, a second seat 705, a first armrest 707 located between the first seat and the second seat, and a modular armrest 709. Modular armrest 709 features a first main member 711 and a second main member 713 and is configured to provide armrests to both the first and the second seats from one modular armrest chair. Modular armrest 709 further comprises a removable cup holder 715 attached by a grooved slot located in the modular armrest 709.

Figure 8C:
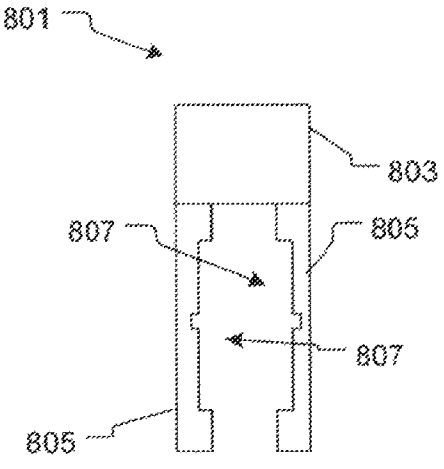
FIG. 8C is an end view of a modular armchair rest illustrated according to the present application.
Figure 8A:
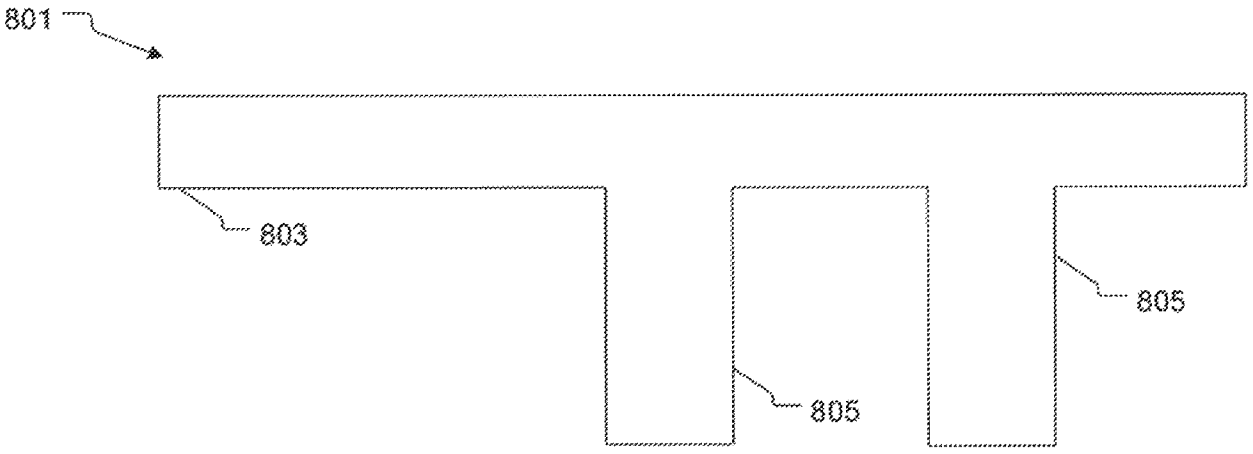
FIG. 8A Is a top view of a modular armchair rest illustrated according to the present application.
Figure 8B:
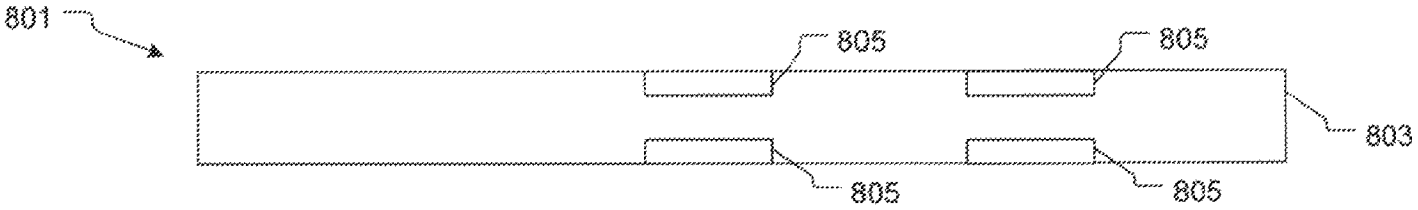
FIG. 8B is a side view of a modular armchair rest illustrated according to the present application.

Referring now also to FIGS. 8A-8C in the drawings, various views of an improved modular armchair rest illustrated according to the present application. Modular armchair rest 801 is comprised of a main member 803 and a plurality of finger 805 extending from the main member 803. Additionally, the plurality of finger 805 feature slots 807 configured to retain either the upper surface of the fixed armrest or the lower rib of the fixed armrest.

Figure 9C:
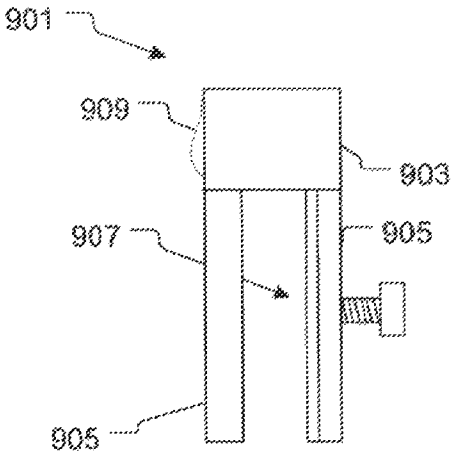
FIG. 9C is an end view of a padded modular armchair rest illustrated according to the present application.
Figure 9A:
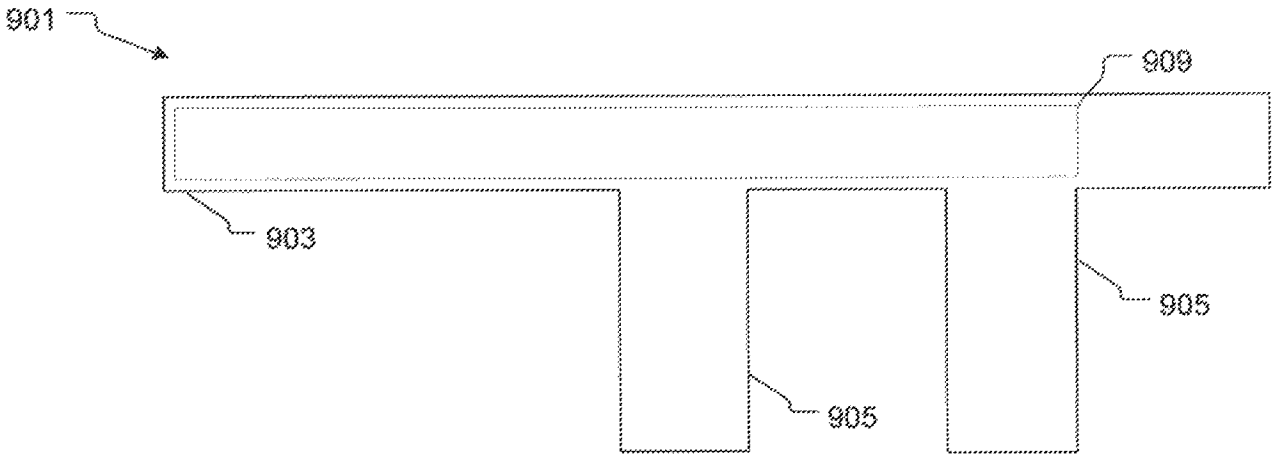
FIG. 9A is a top view of a padded modular armchair rest illustrated according to the present application.
Figure 9B:
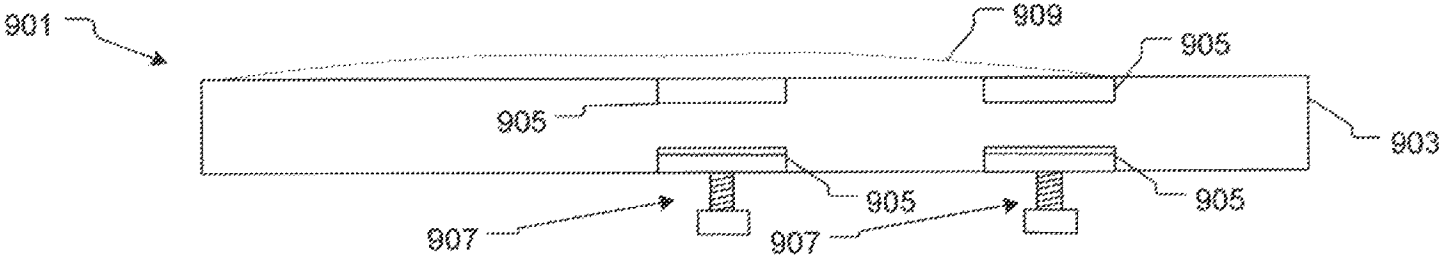
FIG. 9B is a side view of a padded modular armchair rest illustrated according to the present application.

Referring now also to FIGS. 9A-9C in the drawings, various views of an improved modular armchair rest illustrated according to the present application. Modular armchair rest 901 is comprised of a main member 903 and a plurality of finger 905 extending from the main member 903. Additionally, the plurality of finger 905 feature clamps 907 configured to retain either the upper surface of the fixed armrest or the lower rib of the fixed armrest. The user rotates the knob and compresses the fixed armrest between the plurality of fingers and the clamps. Furthermore, rest 901 comprises a padded region 909.

Figures 10A, 10B, 10C:
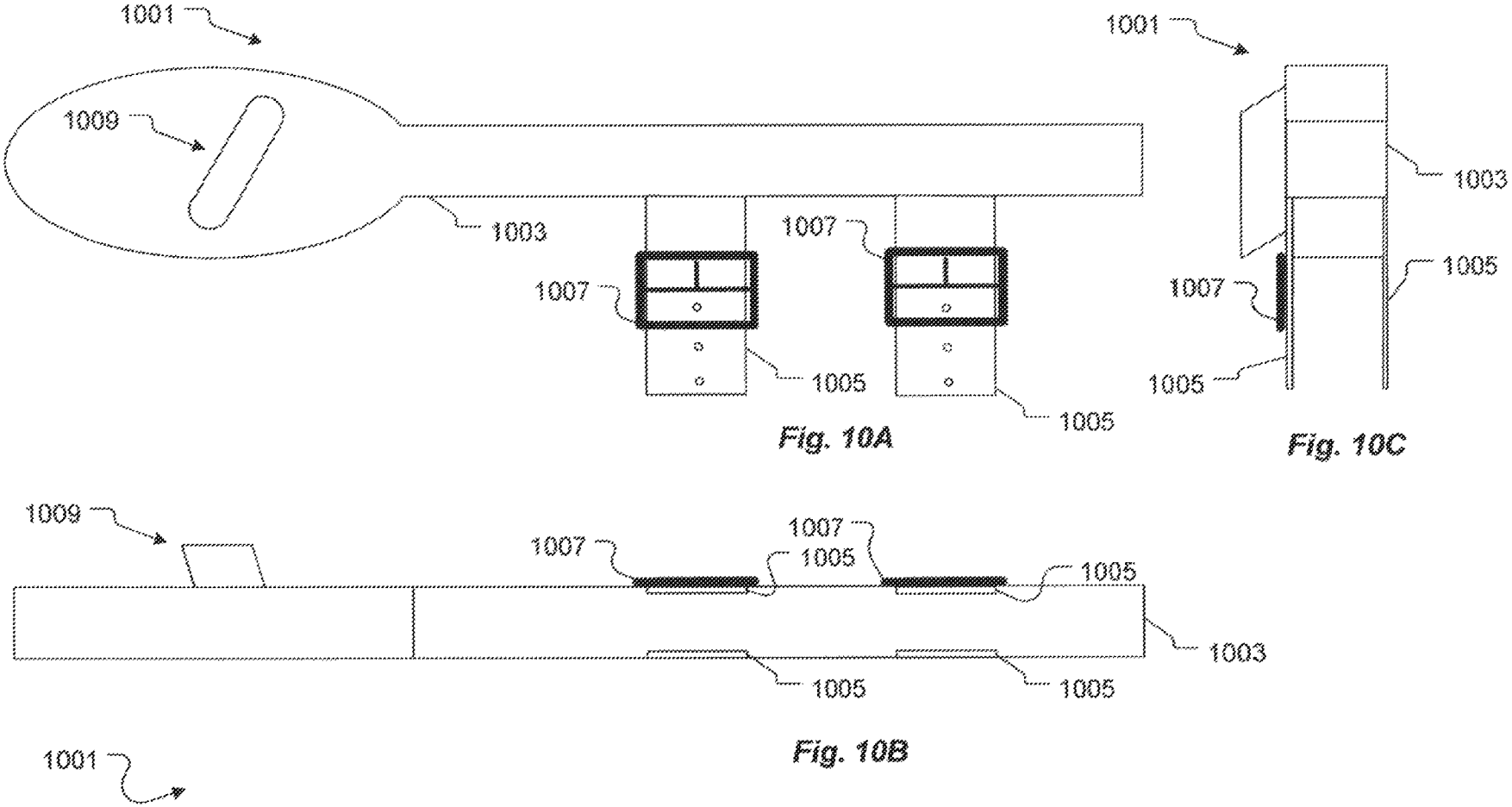
FIG. 10A is a top view of a modular armchair rest having straps illustrated according to the present application.
FIG. 10B is a side view of a modular armchair rest having straps illustrated according to the present application.
FIG. 10C is an end view of a modular armchair rest having straps illustrated according to the present application.

Referring now also to FIGS. 10A-10C in the drawings, various views of an Improved modular armchair rest illustrated according to the present application. Modular armchair rest 1001 is comprised of a main member 1003 having a flared end and a plurality of straps 1005 extending from the main member 1003 along with buckles 1007. Users install the rest 1001 by strapping the unit down and buckling the straps in place around the fixed armrest. In some installation having two modular armchair rests collocated on a single fixed armchair rest, the straps from the first rest can be buckled to the straps of the second unit. Additional rest 1001 comprises a phone holder 1009 located in the flared end of the main member. Phone holder is preferably a slanted opening configured to provide a secure rest for user's phone and allow users to see the screen while held in the rest 1001.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is, therefore, evident that the particular embodiments disclosed above may be altered or modified, and all such variations are considered within the scope and spirit of the application. Accordingly, the protection sought herein Is as set forth in the description. Although the present embodiments are shown above, they are not limited to just these embodiments but are amenable to various changes and modifications without departing from the spirit thereof.

What is claimed is:

1. A modular armchair rest comprising: a first generally elongate member; and a second generally elongate member arranged parallel to and laterally spaced from the first member to provide a single unit; wherein each of the first and second members include at least one free, cantilevered end; wherein the first and second members are configured to be placed on a fixed armrest of a seating arrangement and coupled thereto; and wherein, when coupled to the fixed armrest, the first and second members are spaced to either side of the fixed armrest and arranged above the fixed armrest to provide a usable surface for multiple users.

2. The modular armchair rest according to claim 1, wherein the first member and A the second member are integrally formed as a single unit.

3. The modular armchair rest according to claim 1, further comprising:

a notch in the first member configured to retain an accessory.

4. The modular armchair rest according to claim 3, further comprising:

a cupholder;

wherein the cupholder is removably attached to the first member by the notch.

5. The modular armchair rest according to claim 3, further comprising:

a tray;

wherein the tray is removably attached to the first member by the notch.

* * * * *